US011338167B2

(12) United States Patent
Balelo, Jr.

(10) Patent No.: US 11,338,167 B2
(45) Date of Patent: May 24, 2022

(54) EXERCISE DEVICE AND METHOD OF USE

(71) Applicant: Richard Gonsalves Balelo, Jr., San Diego, CA (US)

(72) Inventor: Richard Gonsalves Balelo, Jr., San Diego, CA (US)

( * ) Notice: Subject to any disclaimer, the term of this patent is extended or adjusted under 35 U.S.C. 154(b) by 0 days.

(21) Appl. No.: 17/088,313

(22) Filed: Nov. 3, 2020

(65) Prior Publication Data

US 2021/0162253 A1 Jun. 3, 2021

Related U.S. Application Data

(60) Provisional application No. 62/942,603, filed on Dec. 2, 2019.

(51) Int. Cl.

| | |
|---|---|
| ***A63B 21/04*** | (2006.01) |
| ***A63B 21/02*** | (2006.01) |
| ***A63B 21/00*** | (2006.01) |
| ***A63B 21/055*** | (2006.01) |
| ***A63B 21/075*** | (2006.01) |

(Continued)

(52) U.S. Cl.

CPC ..... *A63B 21/0442* (2013.01); *A63B 15/00* (2013.01); *A63B 21/00061* (2013.01); *A63B 21/023* (2013.01); *A63B 21/0428* (2013.01); *A63B 21/0552* (2013.01); *A63B 21/075* (2013.01); *A63B 21/0728* (2013.01);

(Continued)

(58) Field of Classification Search

CPC ..... A63B 21/0442; A63B 15/00; A63B 21/00061; A63B 21/023; A63B 21/0428; A63B 21/0552; A63B 21/0728; A63B 21/075; A63B 21/154; A63B 21/4035; A63B 22/18; A63B 21/072; A63B 23/03525; A63B 21/1645; A63B 21/169; A63B 2069/068; A63B 26/003; A63B 15/005; A63B 21/00058–00069; A63B 21/02; A63B 21/022–025; A63B 21/05–0557; A63B 21/06; A63B 21/151; A63B 21/153; A63B 21/155; A63B 22/0076–0089; A63B 22/16

See application file for complete search history.

(56) References Cited

U.S. PATENT DOCUMENTS 4,478,413 A 10/1984 Siwula
5,133,545 A 7/1992 Moschetti et al.

(Continued)

FOREIGN PATENT DOCUMENTS

WO 2009042255 A1 4/2009

*Primary Examiner* — Joshua Lee
*Assistant Examiner* — Catrina A Letterman
(74) *Attorney, Agent, or Firm* — Procopio Cory Hargreaves and Savitch LLP

(57) ABSTRACT

An exercise device that simultaneously incorporates both balance and resistance training comprises a base including a rear and a front portion; a balancer disposed in the base proximal to the front portion of the base and configured to both support a user thereon and move with weight shifting by the user thereon; one or more lines retractably disposed in the front portion of the base; a resistance mechanism disposed in the base and operably associated with the one or more lines, wherein both balance and resistance training are provided by the balancer and the resistance mechanism when a user attempts to balance the user's weight on the balancer while pulling on the one or more lines.

20 Claims, 17 Drawing Sheets

(51) Int. Cl.
*A63B 22/18* (2006.01)
*A63B 15/00* (2006.01)
*A63B 21/072* (2006.01)

(52) U.S. Cl.
CPC ..... *A63B 21/154* (2013.01); *A63B 21/4035* (2015.10); *A63B 22/18* (2013.01)

(56) References Cited

U.S. PATENT DOCUMENTS 5,352,176 A * 10/1994 Huang ..... A63B 21/0004 482/123
5,833,587 A 11/1998 Strong et al.
6,030,321 A 2/2000 Fuentes
6,328,677 B1 * 12/2001 Drapeau ..... A63B 22/0076 482/55
7,601,170 B2 10/2009 Maloy et al.
7,922,624 B1 4/2011 Fairhurst et al.
7,942,793 B2 5/2011 Mills et al.
8,647,239 B1 * 2/2014 Sokolovas ..... A63B 22/18 482/56
9,649,522 B2 5/2017 Wyatt et al.
9,884,220 B2 2/2018 Smith et al.
10,166,447 B2 * 1/2019 Apatini ..... A63B 60/02
2008/0318743 A1 * 12/2008 Bizzell ..... A63B 21/0004 482/142
2011/0275489 A1 * 11/2011 Apau ..... A63B 23/03525 482/73
2012/0244997 A1 9/2012 Thompson
2013/0017932 A1 * 1/2013 Tayebi ..... A63B 69/06 482/94
2013/0090216 A1 4/2013 Jackson
2013/0225375 A1 * 8/2013 Lumsden ..... A63B 22/0076 482/72
2014/0213127 A1 * 7/2014 Bonner ..... B63B 32/77 441/74
2014/0221169 A1 * 8/2014 Bourne ..... A63B 69/0093 482/72
2014/0287884 A1 * 9/2014 Buchanan ..... A63B 21/4023 482/72
2018/0056118 A1 * 3/2018 Bates ..... A63B 69/06
2020/0016470 A1 * 1/2020 Galvin ..... A63B 71/0622

* cited by examiner

EXERCISE DEVICE AND METHOD OF USE

CROSS-REFERENCE TO RELATED APPLICATION

This application claims the benefit under 35 U.S.C. 119 of U.S. Provisional Patent Application No. 62/942,603, filed on Dec. 2, 2019, which is incorporated by reference herein.

FIELD OF THE INVENTION

The present invention relates to exercise devices that simultaneously incorporate balance training, resistance training, cardiovascular benefits, and aerobic benefits.

SUMMARY OF THE INVENTION

An aspect of the invention involves an exercise device that simultaneously incorporates both balance and resistance training comprising a base including a rear and a front portion; a balancer disposed in the base proximal to the front portion of the base and configured to both support a user thereon and move with weight shifting by the user thereon; one or more lines retractably disposed in the front portion of the base; a resistance mechanism disposed in the base and operably associated with the one or more lines, wherein both balance and resistance training are provided by the balancer and the resistance mechanism when a user attempts to balance the user's weight on the balancer while pulling on the one or more lines.

One or more implementations of the aspect of the exercise device described immediately above includes one or more of the following: the base includes a longitudinal direction and a lateral direction, and the balancer includes a movable balancing support that pivots side-to-side in the lateral direction when the user attempts to balance the user's weight on the balancer; the balancer includes a plurality of springs that bias the movable balancing support in an opposite direction from a direction of movement of the movable balancing support when the movable balancing support pivots side-to-side in the lateral direction; the springs are replaceable by springs having different spring constants; the resistance mechanism includes one or more pulleys, one or more cables, and one or more elastic cords; the one or more elastic cords are replaceable by one or more elastic cords having different elasticities; a paddle having one or more tubes having a grip at one end and an opposite end coupled to the one or more lines; the opposite end includes a blade that is coupled to the one or more lines; the blade includes one or more weight-receiving holders and one or more weights received in the one or more weight-receiving holders, wherein paddling resistance is varied depending on the amount of the one or more weights received in the one or more weight-receiving holders; the blade includes one or more couplers coupled to the one or more lines; the one or more couplers include a plurality of couplers spaced at varying distances, wherein paddling resistance is varied depending on which coupler the one or more lines is coupled to; the paddle has a configuration of a SUP paddle; and/or a cover on top of the base, and the cover has a configuration of a SUP.

Another aspect of the invention involves a method of using the exercise device of claim of aspect of the invention described further above and comprises providing balance training with the exercise device by supporting a user on the balancer and the balancer moving with weight shifting by the user thereon; and providing resistance training with the exercise device via the one or more lines by the resistance mechanism by the user pulling on the one or more lines.

One or more implementations of the aspect of the exercise device described immediately above includes one or more of the following: the base includes a longitudinal direction and a lateral direction, and the balancer includes a movable balancing support that pivots side-to-side in the lateral direction when the user attempts to balance the user's weight on the balancer, and providing balance training includes the movable balancing support pivoting side-to-side in the lateral direction when the user attempts to balance the user's weight on the balancer; the balancer includes a plurality of springs that bias the movable balancing support in an opposite direction from a direction of movement of the movable balancing support when the movable balancing support pivots side-to-side in the lateral direction, and providing balance training includes the plurality of springs biasing the movable balancing support in an opposite direction from a direction of movement of the movable balancing support when the movable balancing support pivots side-to-side in the lateral direction; the springs are replaceable by springs having different spring constants, and the method includes the springs being replaced by springs having different spring constants; the resistance mechanism includes one or more replaceable elastic cords, and the method includes the one or more replaceable elastic cords being replaced by one or more elastic cords having different elasticities to vary resistance training; a paddle having one or more tubes having a grip at one end and an opposite end with a blade coupled to the one or more lines, the blade including one or more weight-receiving holders and one or more weights received in the one or more weight-receiving holders, and the method includes varying paddling resistance by replacing the one or more weights with one or more different weights in the one or more weight-receiving holders; and/or a paddle having one or more tubes having a grip at one end and an opposite end with a blade coupled to the one or more lines, the blade including one or more couplers coupled to the one or more lines, the one or more couplers including a plurality of couplers spaced at varying distances, and the method includes varying paddling resistance by varying which coupler the one or more lines is coupled to.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1:
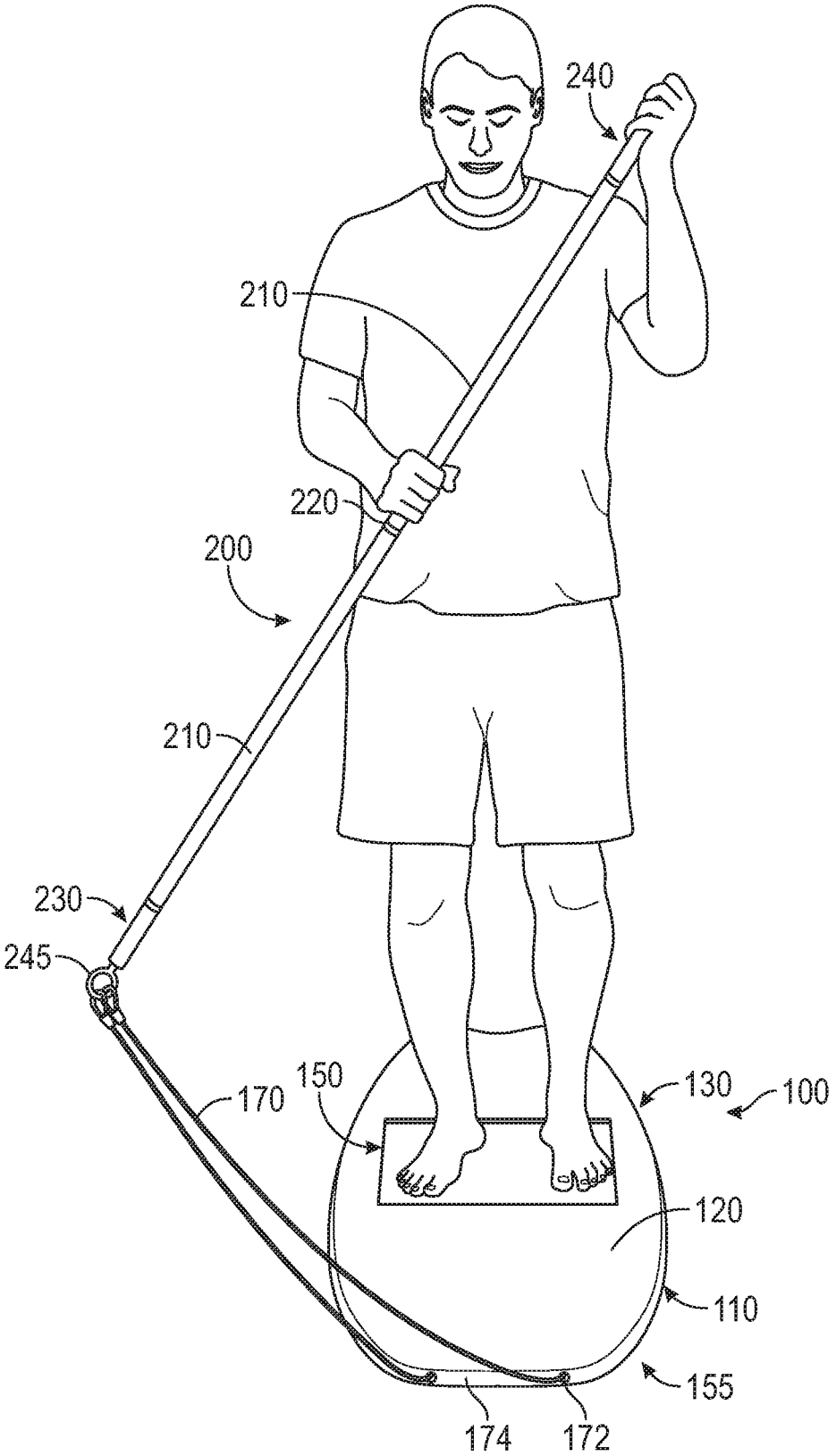
FIG. 1 is a perspective view of embodiment of an exercise device, and shows a user performing a stand-up paddle board rowing exercise while balancing on a balancing support with the exercise device.

With reference to FIGS. 1-8, an embodiment of an exercise device 100 and method of using the same will be described.

The exercise device 100 includes a base 110 with an upper support surface 120. In the embodiment shown, the base 110 is in the configuration of a surfboard with no fin or the fin removed, but in alternative embodiments, the base 110 has different configurations such as, but not limited to, a flat rectangular configuration, a flat square configuration, a flat circular configuration, a foldable configuration. A central portion 130 of the base 110 includes a recess 140 that receives a movable balancing support 150, which may comprise and/or include a foam pad for more additional comfort for the user's feet. As shown in the bottom plan view of FIG. 8, a front portion/nose 155 of the base 110 includes one or more pulling spring-loaded resistance mechanisms (e.g., two) 160. The one or more pulling resistance mechanisms 160 are accessible on a bottom 162 of the base 110 via a door 164. The one or more pulling resistance mechanisms 160 each include a retractable line (e.g., cable, cord) 170 that extends through a respective hole, channel, groove, or guide 172 on a front 174 of the base 110. The one or more pulling resistance mechanisms 160 provide a pulling resistance when the retractable cord/cable 170 is pulled out from and retracts back into the one or more pulling resistance mechanisms 160.

In an alternative embodiment, one or more elastic cords/cables replace the one or more retractable cords/cables 170 and the one or more pulling resistance mechanisms 160. In this embodiment, instead of the one or more pulling resistance mechanisms 160 providing the pulling resistance, the elastic nature of the one or more elastic cords/cables provides the pulling resistance.

Figure 2:
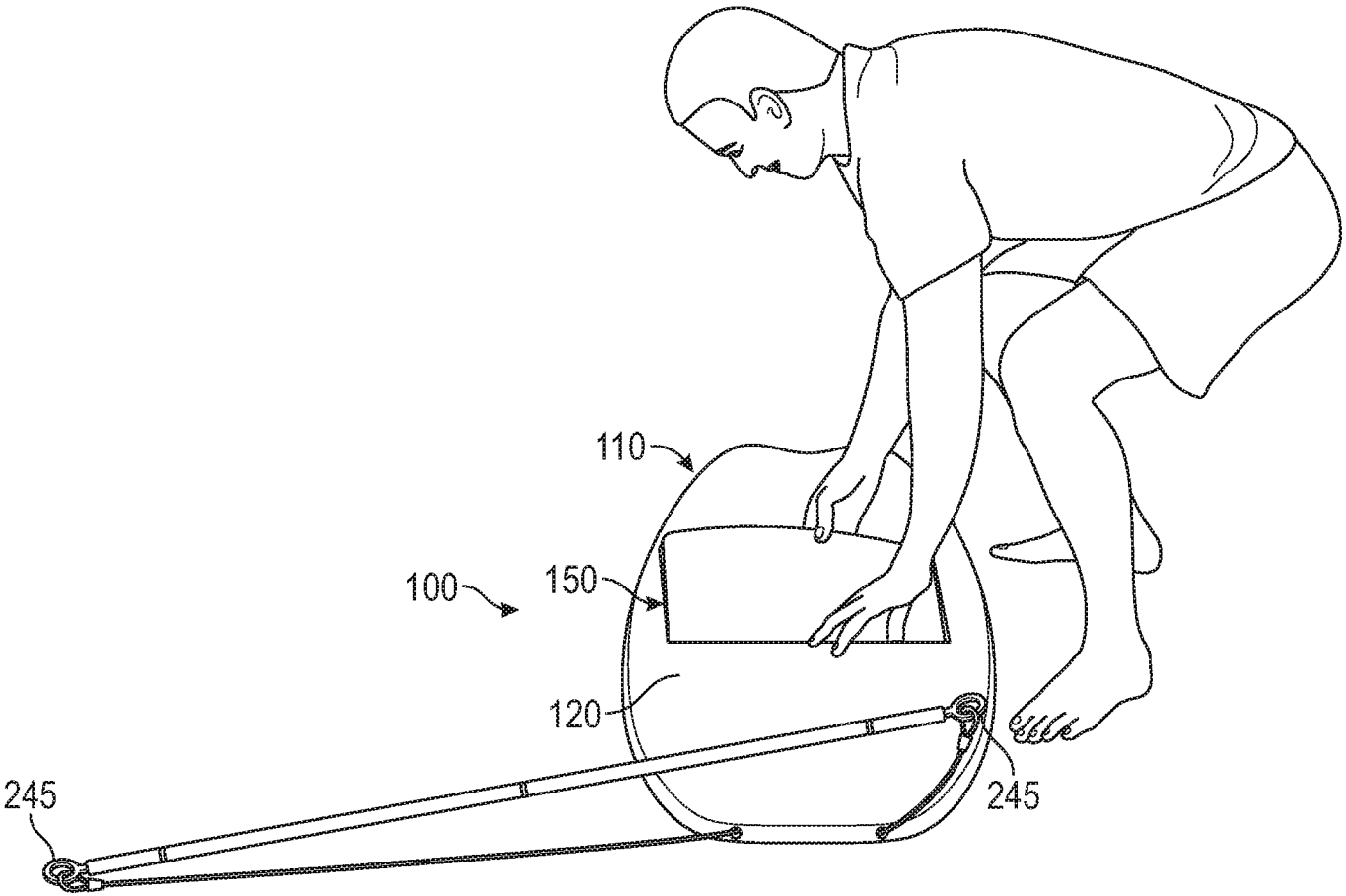
FIG. 2 is a perspective view of the exercise device of FIG. 1 and shows the user removing an embodiment of a movable balancing support.
Figure 3:
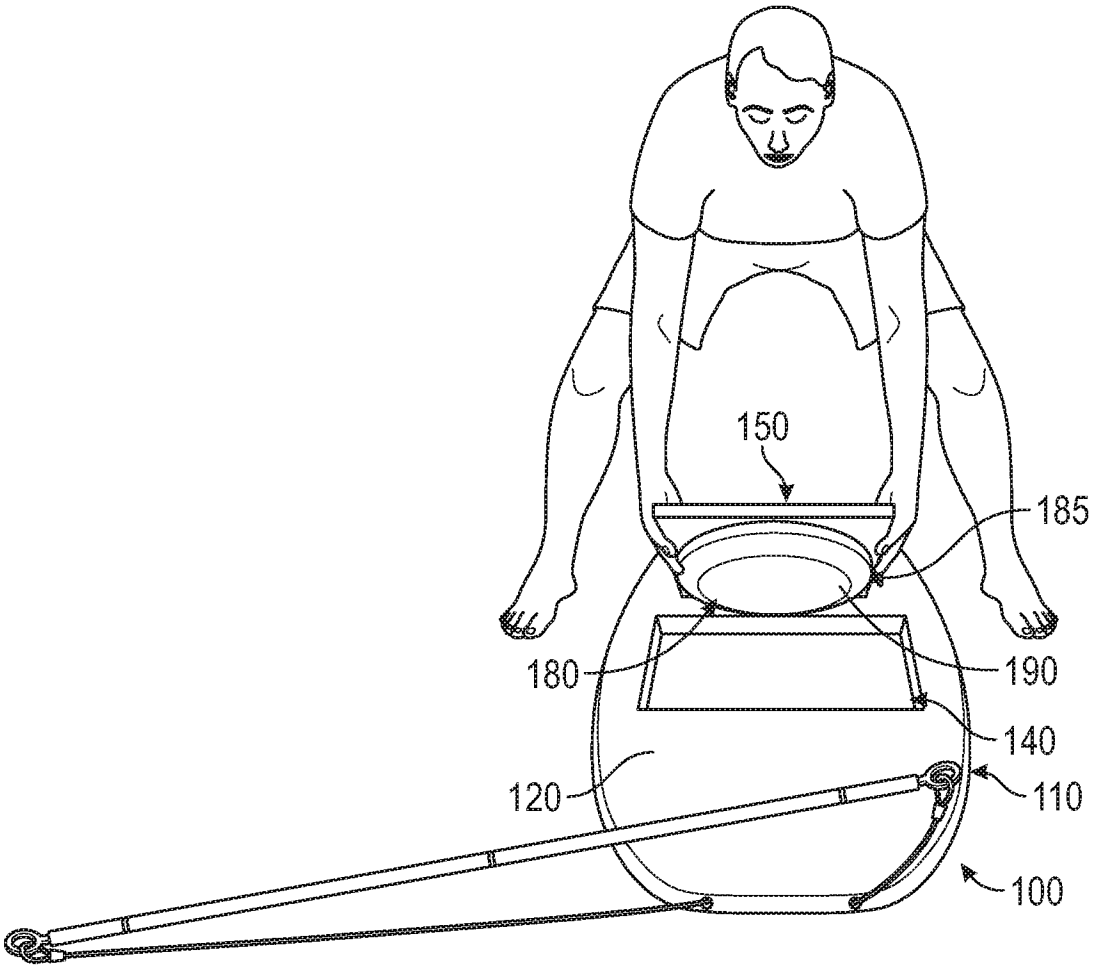
FIG. 3 is a perspective view of the exercise device of FIG. 1 and shows the user removing the movable balancing support to adjust the stability of the movable balancing support.

As shown in FIGS. 2 and 3, a user may replace the movable balancing support 150 with an alternative movable balancing support 150 that is more or less stable than the replaced movable balancing support 150 or a balance adjustment mechanism 180 may be adjusted to adjust the balancing effect/stability of the movable balancing support 150. The balance adjustment mechanism 180 may include an inflatable/deflatable air bladder/disc, which may include an openable/closeable nozzle/port 185 for inflating/deflating the bladder. The more inflated the balance adjustment mechanism 180, the balance adjustment mechanism 180 will have a more convex lower surface 190, providing more instability when a user tries to balance on the movable balancing support 150. The less inflated the balance adjustment mechanism 180, the balance adjustment mechanism 180 will have a flatter lower surface 190, providing more stability when a user tries to balance on the movable balancing support 150. In alternative embodiments, the movable balancing support 150 may be replaced with a replacement movable balancing support 150 that is configured to be less stable or more stable. In a further embodiment, the movable balancing support 150 is not removable from the base 110, and stability of the balance adjustment mechanism 180 is adjusted by turning a dial or providing other input to the balance adjustment mechanism 180, which is permanently disposed under the movable balancing support 150 (e.g., as part of the movable balancing support and/or as part of the base 110).

As shown in FIGS. 4-7, the user may perform a variety of resistance training exercises (e.g., with one's arms) while trying to maintain one's balance on the movable balancing support 150.

Figure 5:
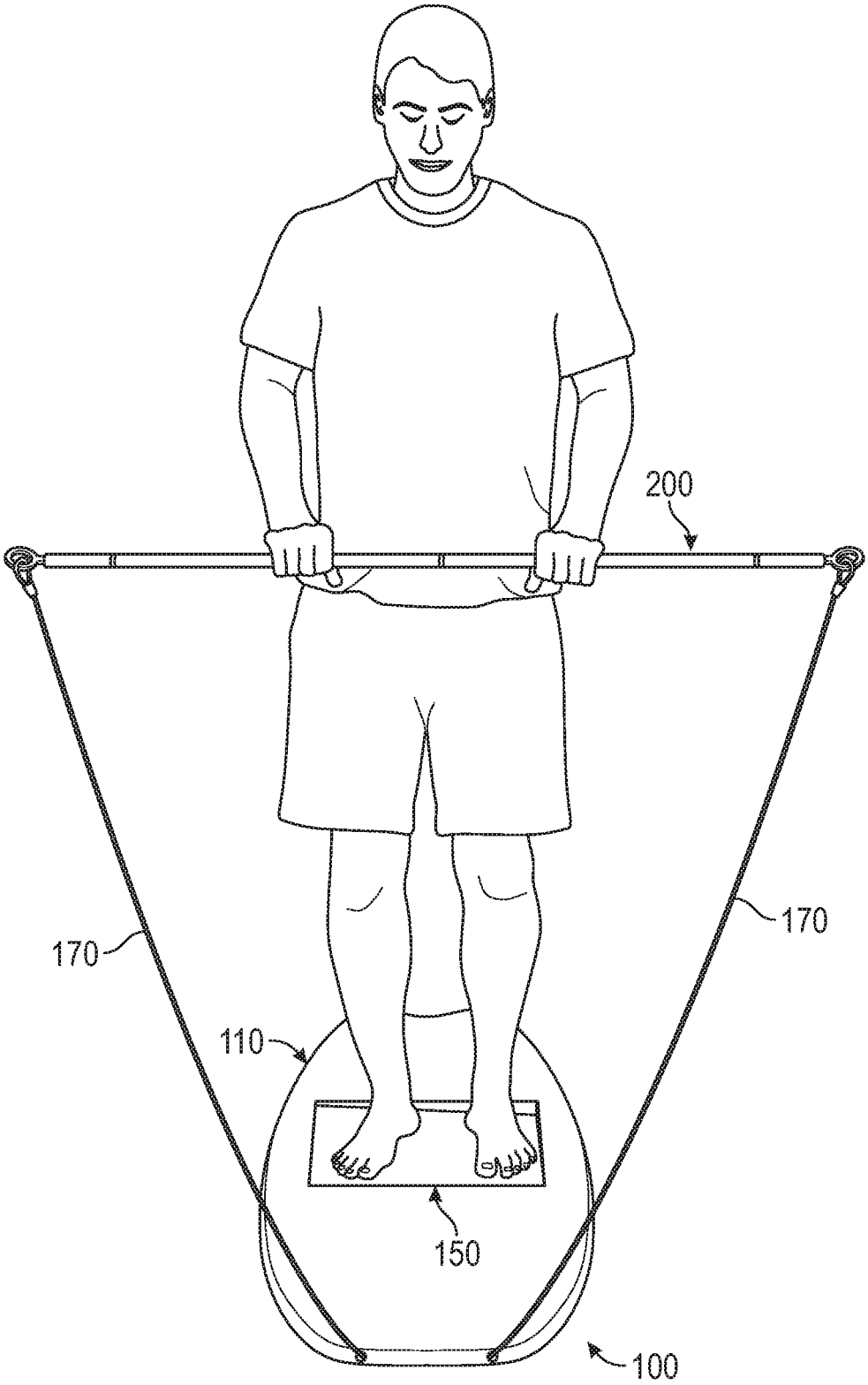
FIG. 5 is a perspective view of the exercise device, similar to FIG. 4, and shows the user continuing to perform resistance training with one's arms while balancing on the less stable movable balancing support.
Figure 6:
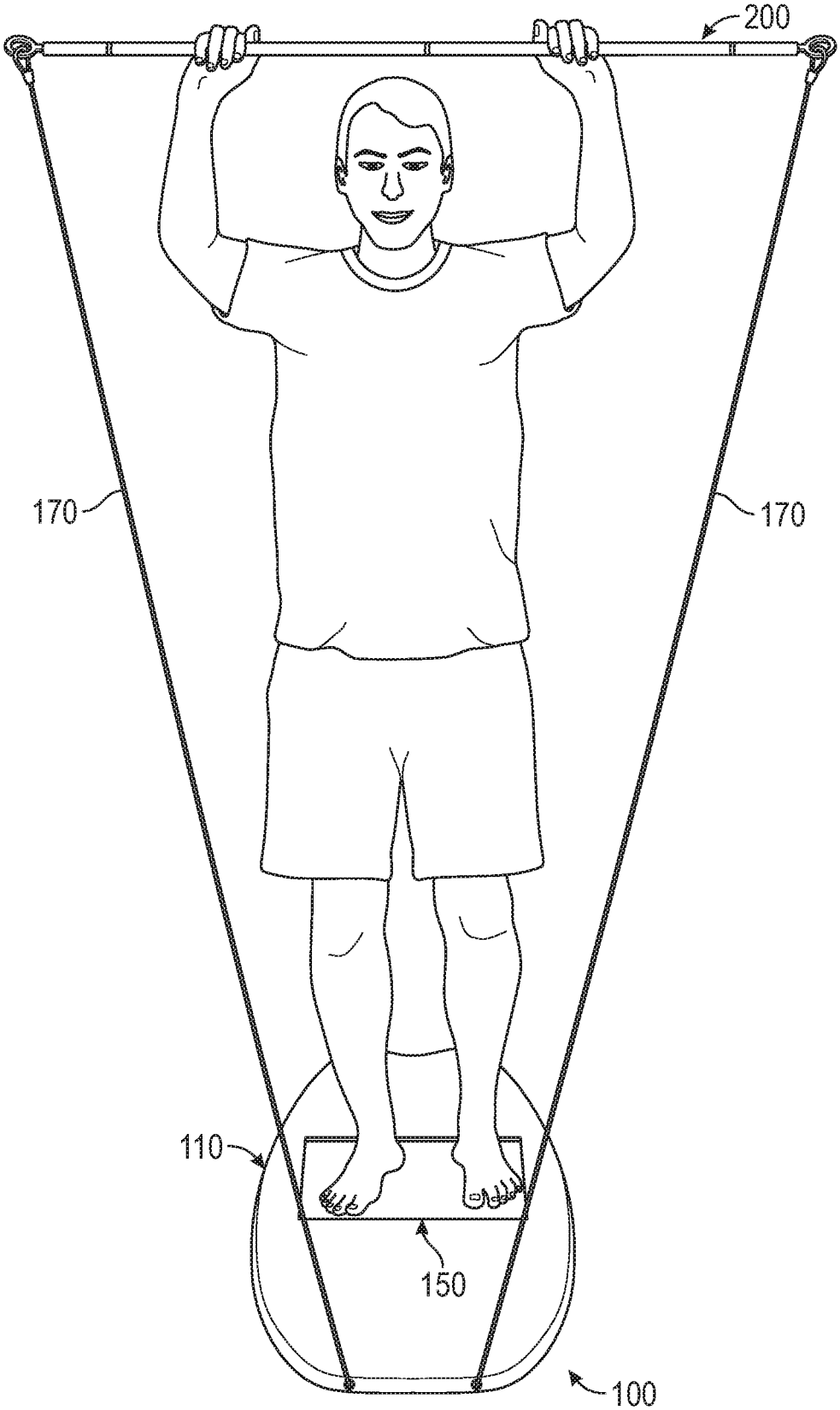
FIG. 6 is a perspective view of the exercise device, similar to FIG. 4, and shows the user continuing to perform resistance training with one's arms while balancing on the less stable movable balancing support.
Figure 7:
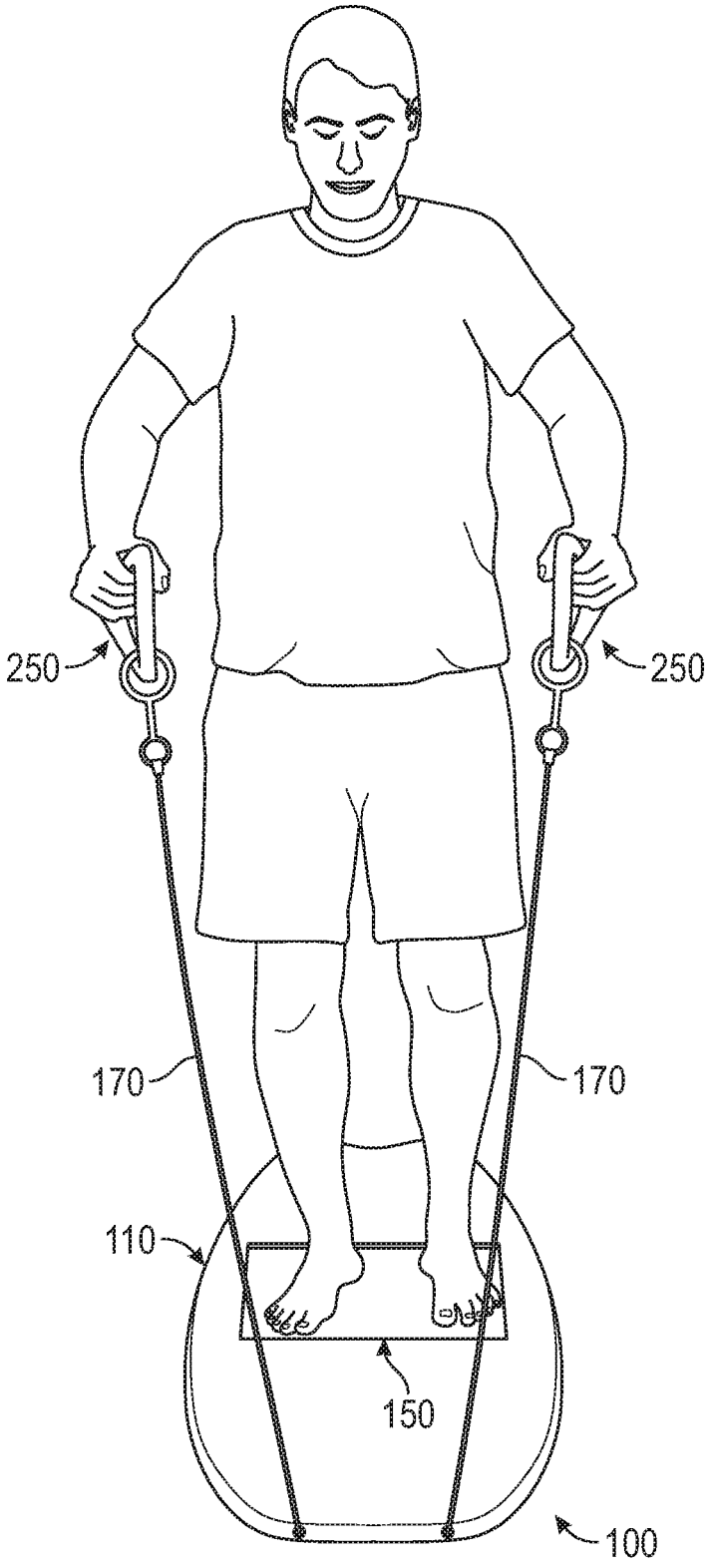
FIG. 7 is a perspective view of the exercise device of FIG. 1 and shows performing a different type of resistance training with one's arms while balancing on the less stable movable balancing support.
Figure 8:
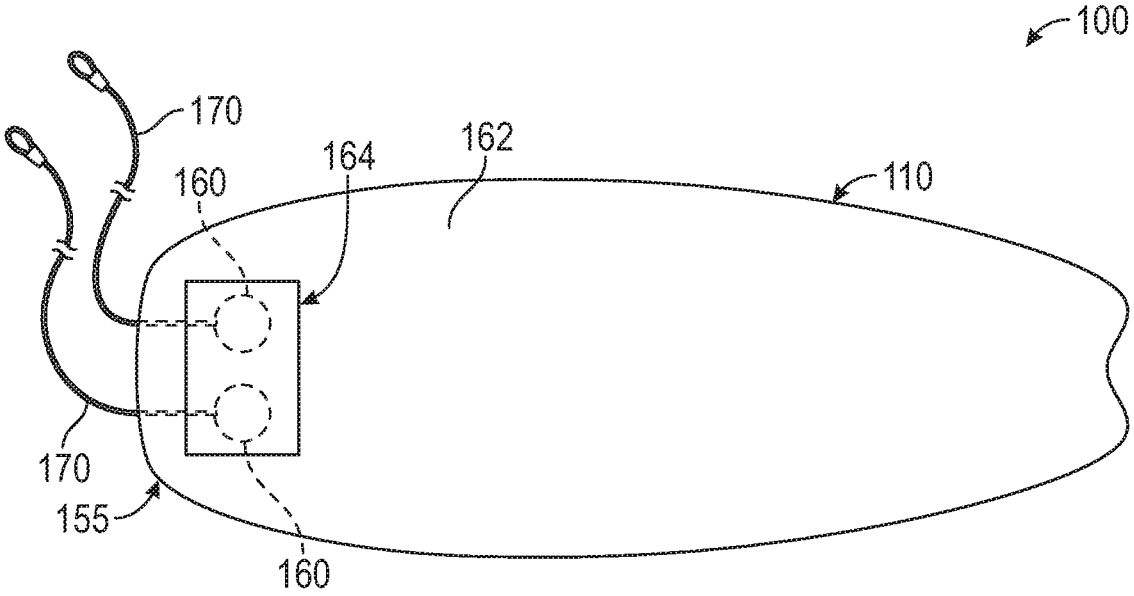
FIG. 8 is a bottom plan view of the exercise device.

As shown in FIGS. 1 and 4-6, an exercise pole 200 includes intermediate pole sections 210 that may be telescopingly coupled together to adjust a length of the pole 200. At a center section 220, the intermediate pole sections 210 may lock together in any well-known manner to fix the length of the exercise pole 200. The exercise pole 200 may include opposite removable end sections 230, 240. The end sections 230, 240 may include eyelets 245 for connecting ends of the cables 170 to the end(s) of the exercise pole 200. In FIG. 1, the end section 240 is shown as a stand-up paddle board grip. As shown in FIG. 7, the ends of the cables 170 are coupled to exercise handles 250.

Exercises with the exercise device 100 may be performed in various positions (e.g., facing the front portion/nose 155 of the base 110, facing either side of the base 110, facing the rear of the base 110, standing; both legs, on one leg, staggered position; kneeling; both knees, one knee; sitting). Examples of exercises that may be performed with the exercise device 100 include, but are not limited to following: standing exercises (e.g., paddling, rowing, chest presses, overhead presses, alternating arms forward and backward PNF patterns, Rotator Cuff exercises); kneeling exercises (e.g., kettle bells, squats, squat and press, single leg squats, front lunges, side lunges, diagonal lunges, biceps curls, triceps presses, heel raises, toe raises, reverse flies, shoulder externally and internally rotation, PNF patterns); sideways exercises (e.g., PNF patterns, shoulder abduction, trunk rotation); sitting exercises (e.g., paddling, rowing, chest presses, PNF patterns); lying face up/supine exercises (e.g., shoulder extension, abduction pull downs, PNF patterns).

Figure 4:
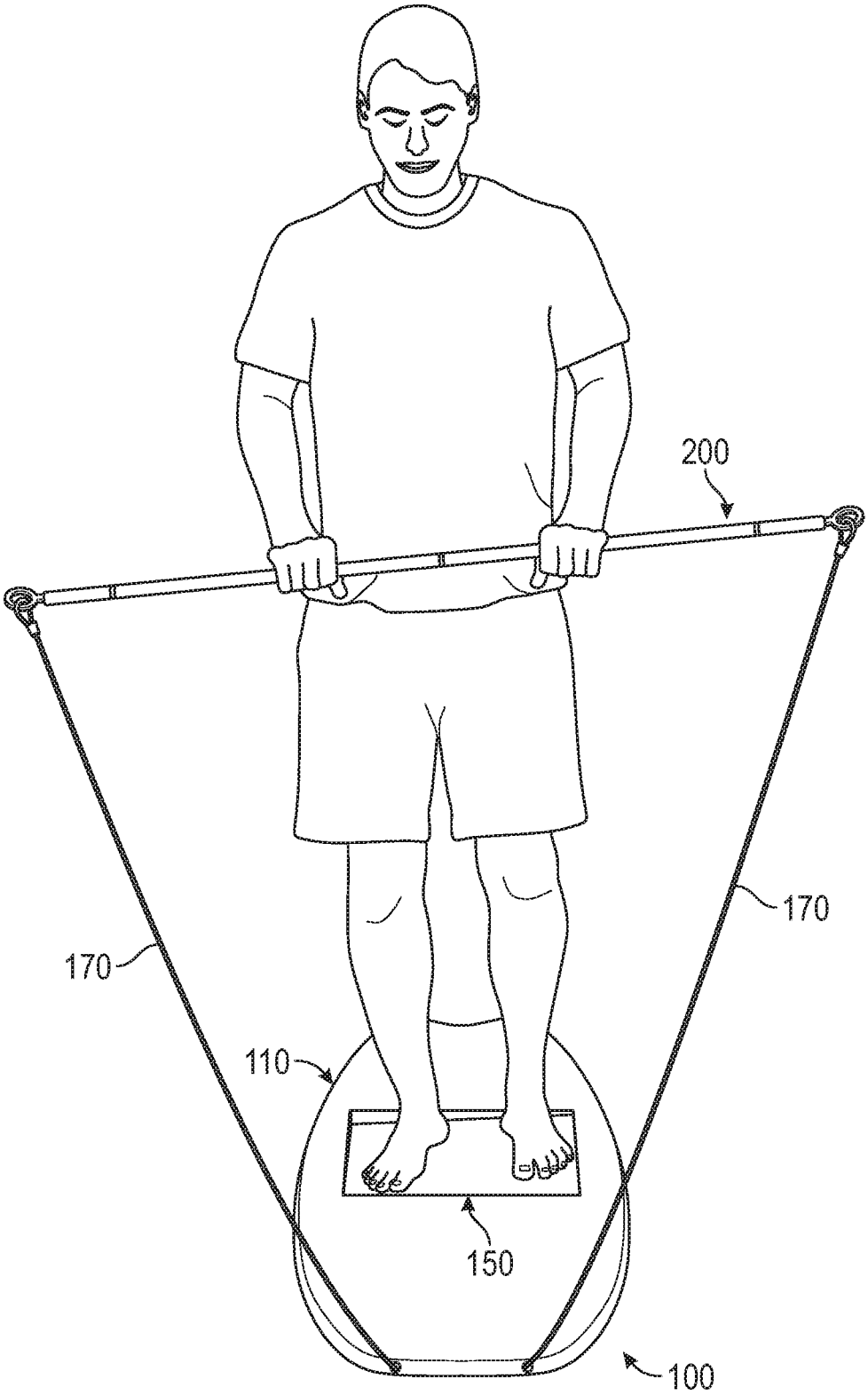
FIG. 4 is a perspective view of the exercise device of FIG. 1 and shows the user performing resistance training with one's arms while balancing on the movable balancing support that has been adjusted to be less stable.

FIG. 1 shows the user standing forward, facing the front portion/nose 155 of the base 110, performing a stand-up paddle board rowing exercise while balancing on the movable balancing support 150 of the exercise device 100. FIGS. 4-6 show the user standing forward, facing the front portion/nose 155 of the base 110, performing rows or overhead press while balancing on the movable balancing support 150 of the exercise device 100.

With reference to FIGS. 9-20, another embodiment of an exercise device 300 and method of using the same will be described.

The exercise device 300 includes a base or frame 310 with an upper support surface or cover 320. In the embodiment shown, the base 310 and cover 320 are in the configuration of a surfboard with no fin or the fin removed, but in alternative embodiments, the base 310 and the cover 320 have different configurations such as, but not limited to, a flat rectangular configuration, a flat square configuration, a flat circular configuration, a foldable configuration.

Figure 11:
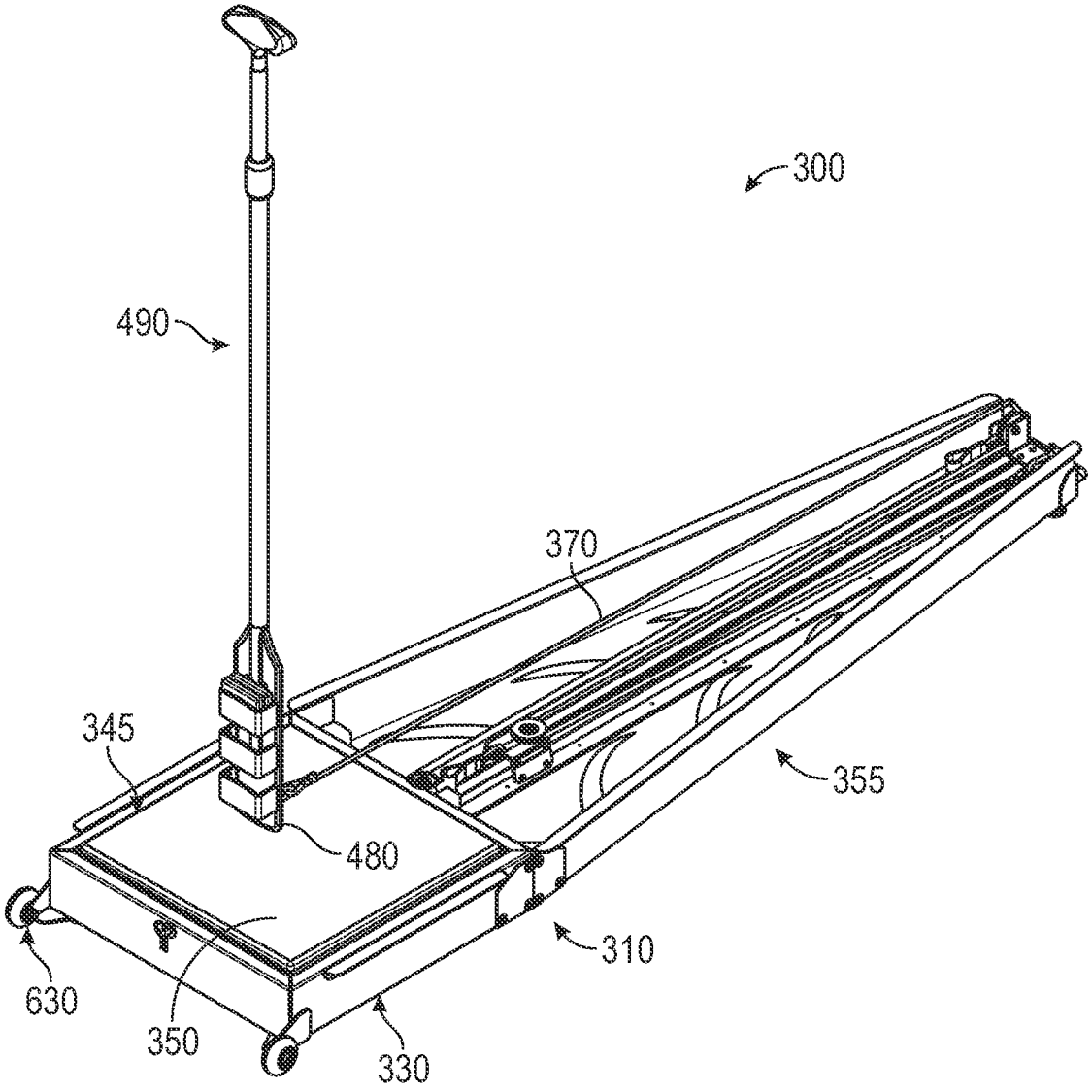
FIG. 11 is a perspective view of the exercise device of FIG. 9 with a cover/upper support surface removed and a paddle shown.
Figure 12:
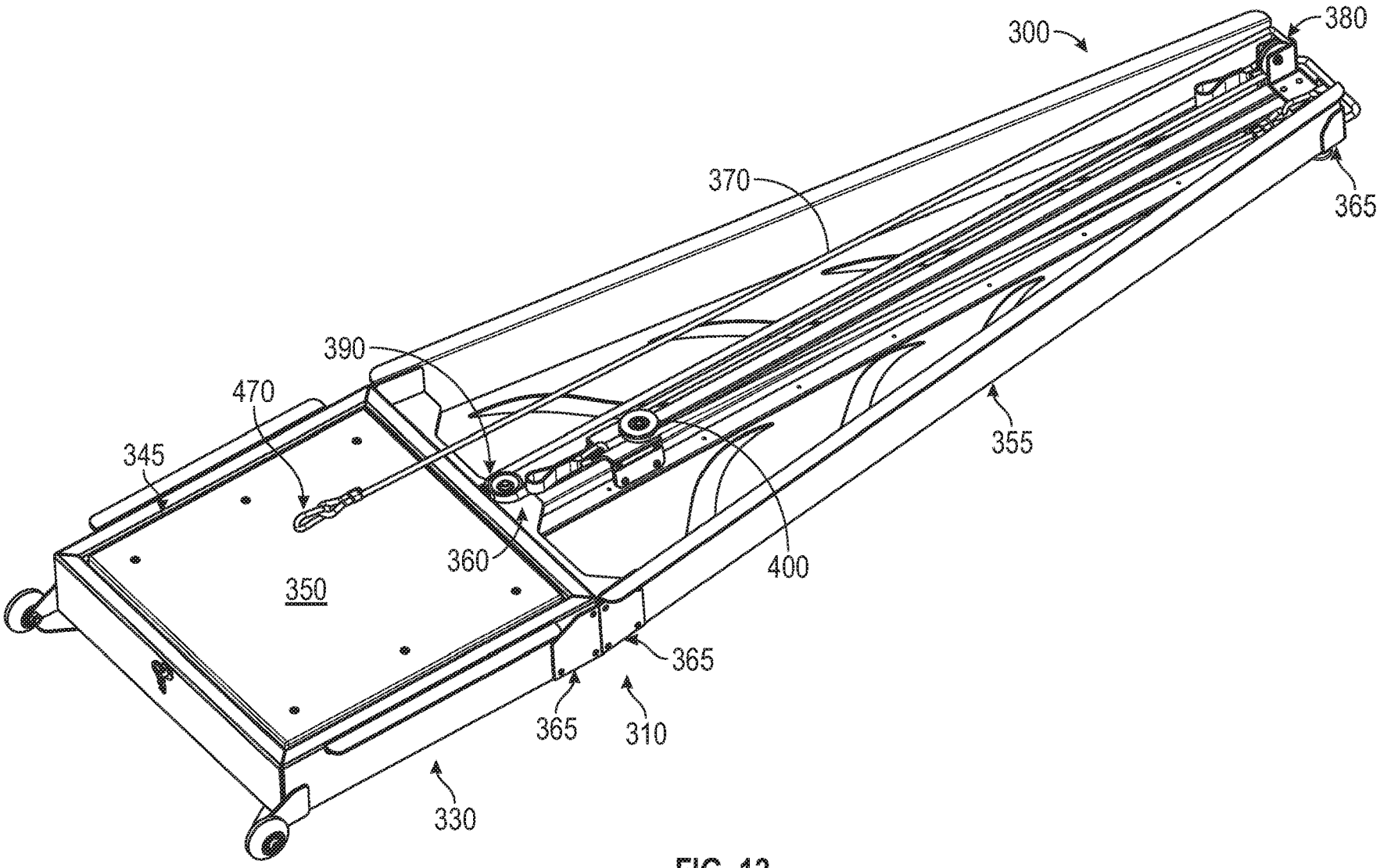
FIG. 12 is a perspective view of the exercise device of FIG. 9, similar to FIG. 11, but without the paddle shown.
Figure 13:
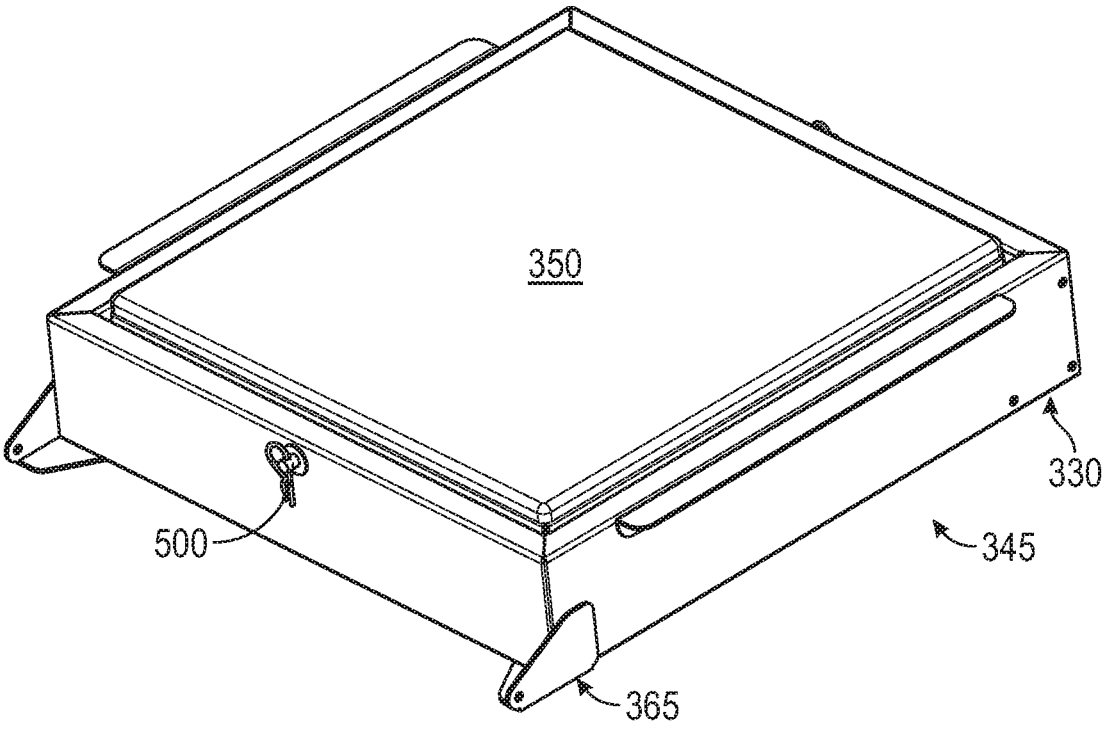
FIG. 13 is a perspective view of an embodiment of a balancer of the exercise device of FIG. 9.

A rear rectangular frame or portion 330 of the base 310 includes a recess 340 that receives a balancer 345 including a movable balancing support 350, which may comprise and/or include a padded surface (e.g., rubber pad, foam pad) for additional comfort for the user's feet. As shown in FIG. 11, a front triangular frame or portion 355 in front of or distal to the balancer 345 in the base 310 is a resistance mechanism 360. Brackets 365 and/or other fasteners secure the rear rectangular frame 330, the front triangular frame 355, and other components of the exercise device 300 together. The balancer 345 and the base 310 are coplanar.

The resistance mechanism 360 includes a retractable cord/cable 370 that extends through a hole, channel, groove, or guide 372 in a front 374 of the cover 320. The resistance mechanism 360 provides a pulling resistance when the retractable cord/cable 370 is pulled out from and retracts back into the resistance mechanism 360 and the base 310. The resistance mechanism includes pulleys 380, 390, 400, retractable cord/cable 370, and replacement bungee cord or elastic cord 430. The elastic cord 430 is fixed at one end and near an opposite end, the elastic cord 430 passes around the pulley 400, which is coupled to a slide member 450, which slides along a rail 460 of the front triangular frame or portion 355 with movement of the retractable cord/cable 370. Resistance in the resistance mechanism 360 can be varied by replacing the elastic cord 430 with different elastic cords of varying elasticity. A connector 470 at a terminal end of the retractable cord/cable 370 couples with a lower portion 480 of paddle 490.

Figure 14:
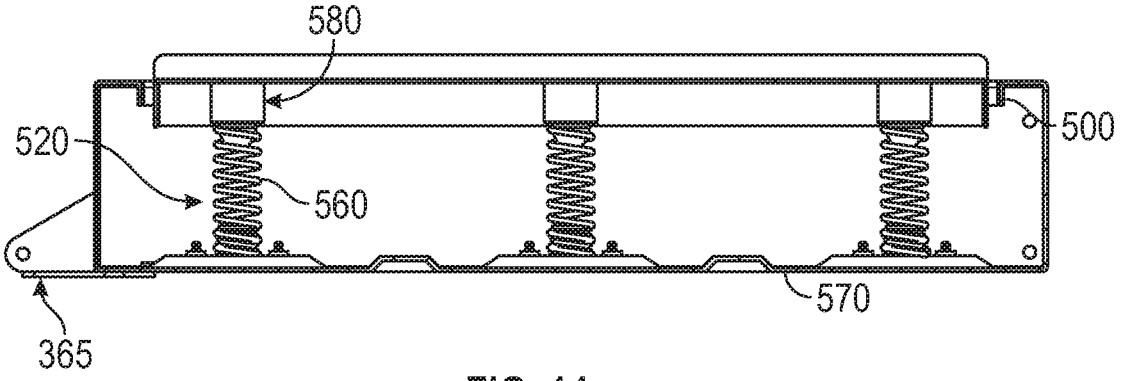
FIG. 14 is a cross-sectional view of the balancer of FIG. 13.
Figure 15:
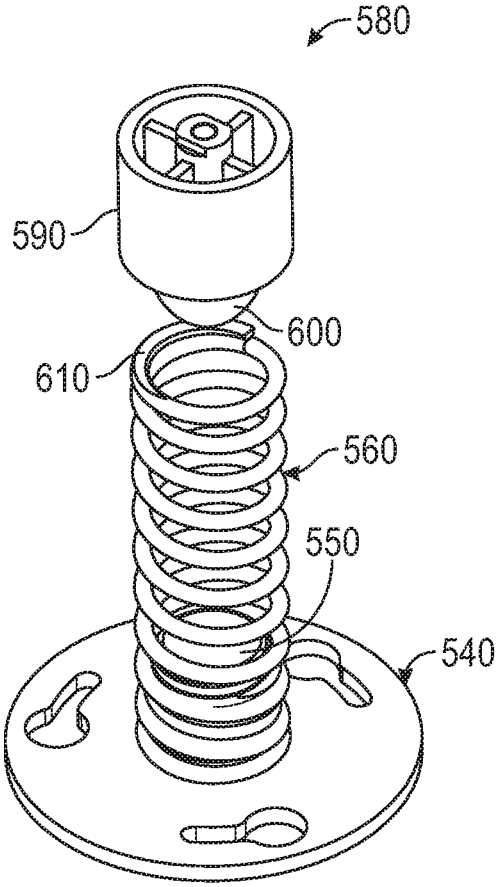
FIG. 15 is a top perspective view of an embodiment of a replaceable spring assembly of the balancer of FIG. 13.
Figure 16:
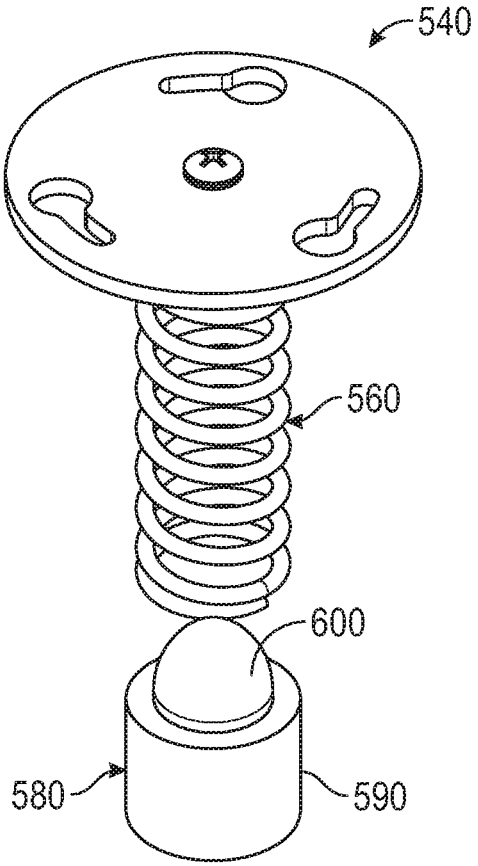
FIG. 16 is a bottom perspective view of the replaceable spring assembly of FIG. 15.
Figure 17:
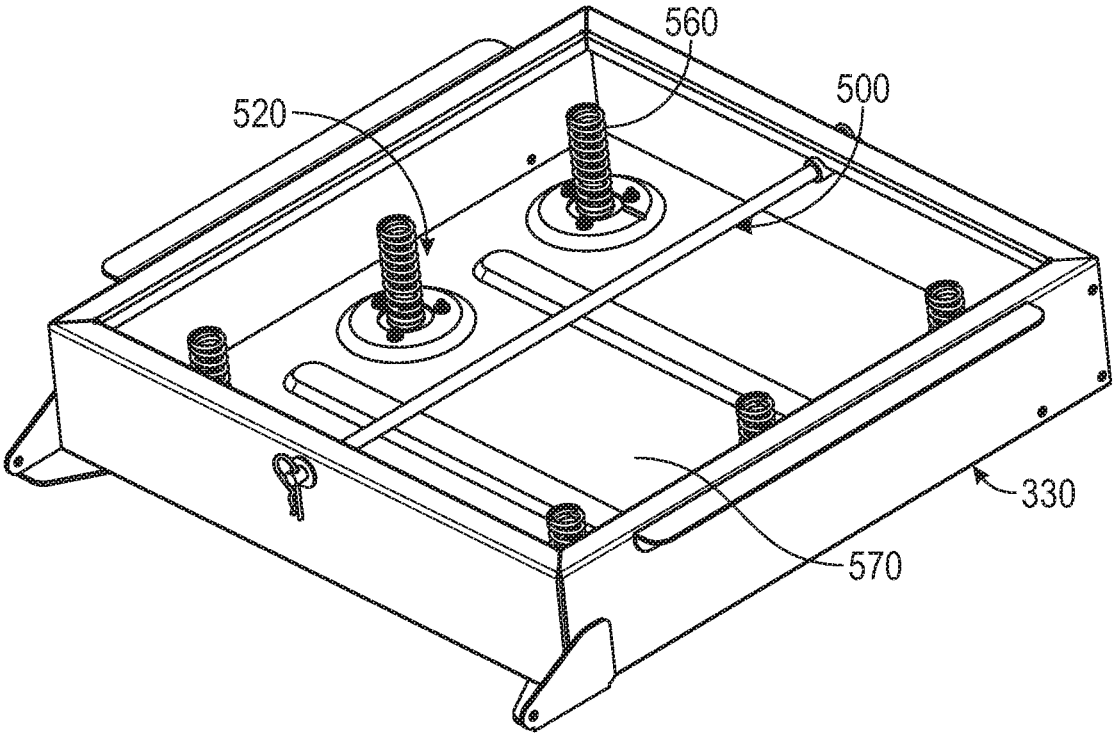
FIG. 17 is a top perspective view of the balancer of FIG. 13 with a movable balancing support removed.
Figure 18:
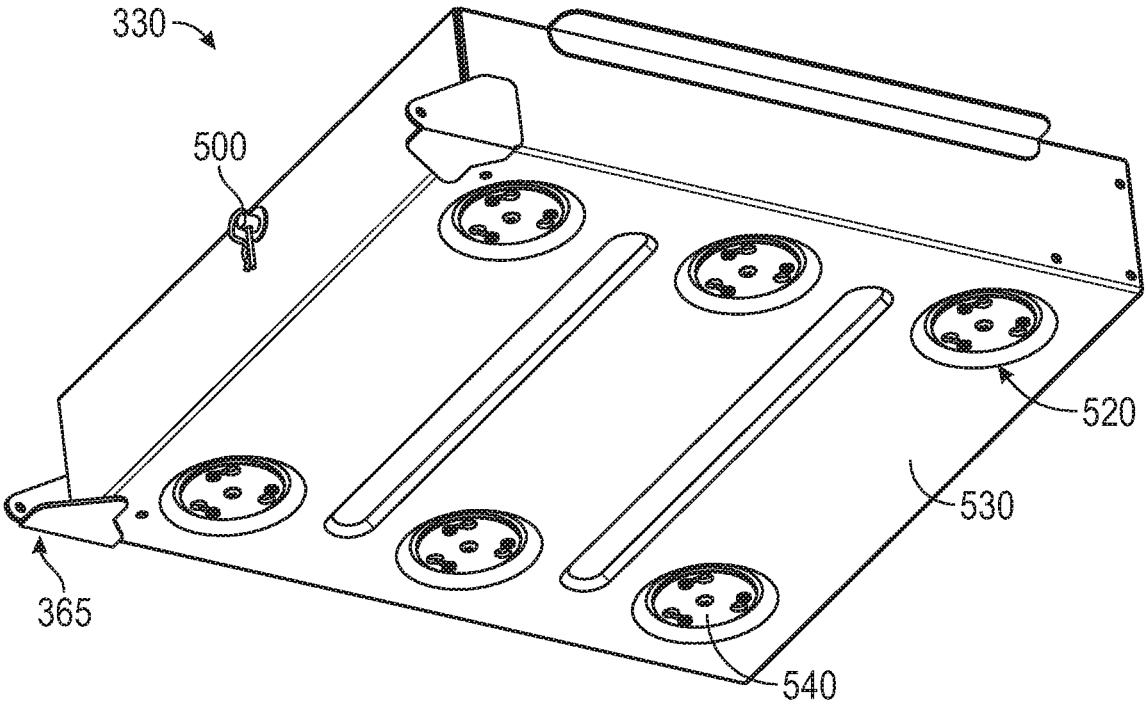
FIG. 18 is a bottom perspective view of the balancer of FIG. 13.

With reference to FIGS. 13-18, the balancer 345 includes a pivot pin 500 that the movable balancing support 350 is pivotally coupled to at pivot member(s) 510. A plurality of spring assemblies 520 are attached to a bottom 530 of rear rectangular frame or portion 330 of the base 310. The spring assemblies 520 each include a circular plate 540, a spring holding cylinder 550 that extends from a center of the circular plate 540, and a spring 560 that receives the spring holding cylinder 550 at one end. The circular plate 540 includes a plurality of fastener holes for receiving fasteners to attach the circular plates 540 (with springs 560) to an underside of a bottom plate 570 of the rear rectangular frame 330. The springs 560 extend through holes in the bottom plate 570. A plurality spring engagers 580 are attached to an underside of the movable balancing support 350. The spring engagers 580 include a cylindrical body 590 with a spheroid or other three-dimensional curvilinear body 600 extending there from. As shown in FIG. 14, as the movable balancing support 350 pivots side-to-side, the spring engagers 580 engage top portion 610 of the springs 560, urging the spring engagers 580 and the respective side of the movable balancing support 350 in an opposite direction, inhibiting the movable balancing support 350 from tilting too far in either direction, right or left. A bottom end 620 of the rear rectangular frame or portion 330 of the base 310 includes rolling wheels 630 coupled thereto via flanges 640 and fasteners 650. At an opposite end of the base 310, a handle 655 is coupled to the distal end 440 of the front triangular frame or portion 355 to grab with one's hand to facilitate moving the exercise device 300.

Figure 10:
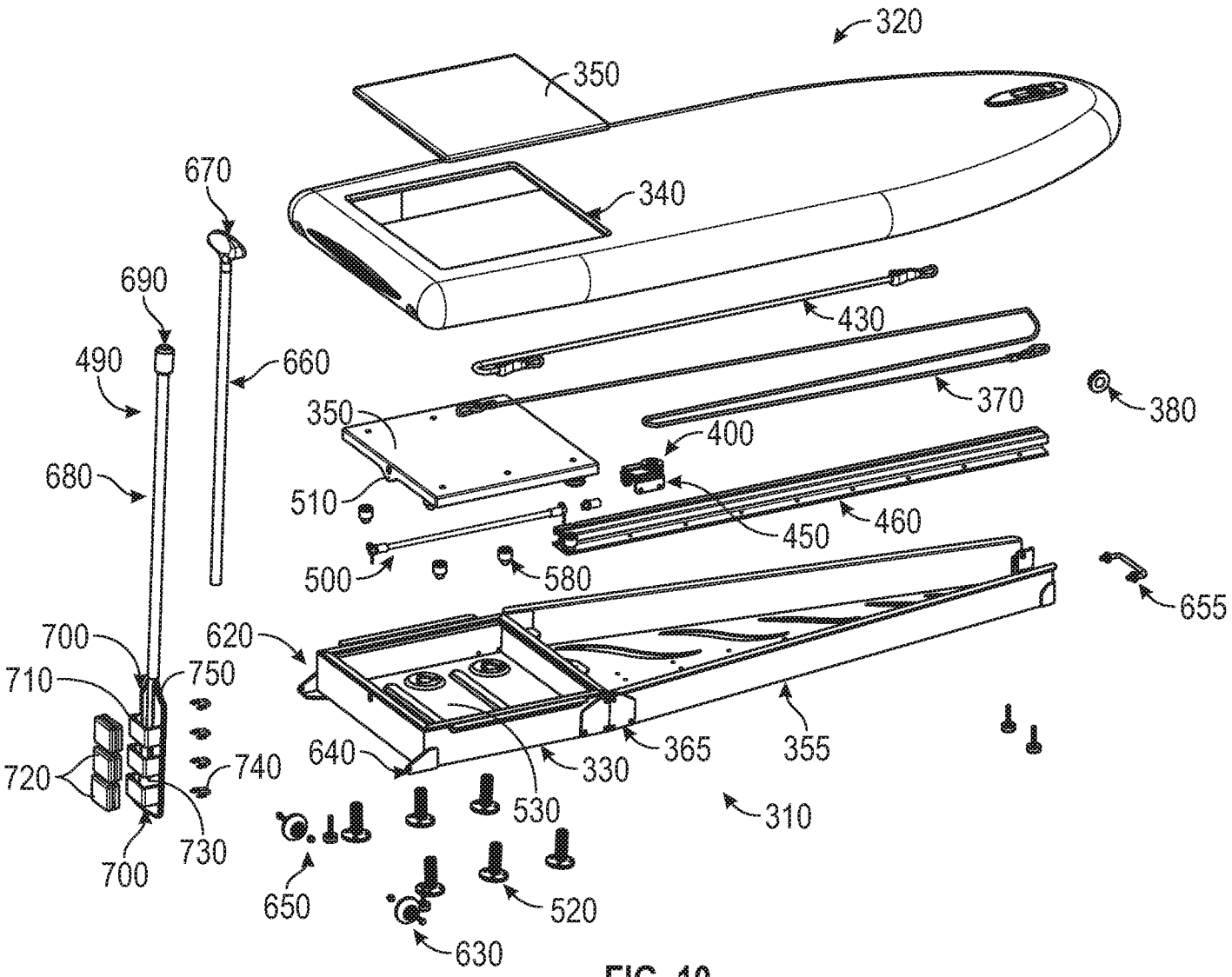
FIG. 10 is an exploded perspective view of the exercise device of FIG. 9.
Figure 19:
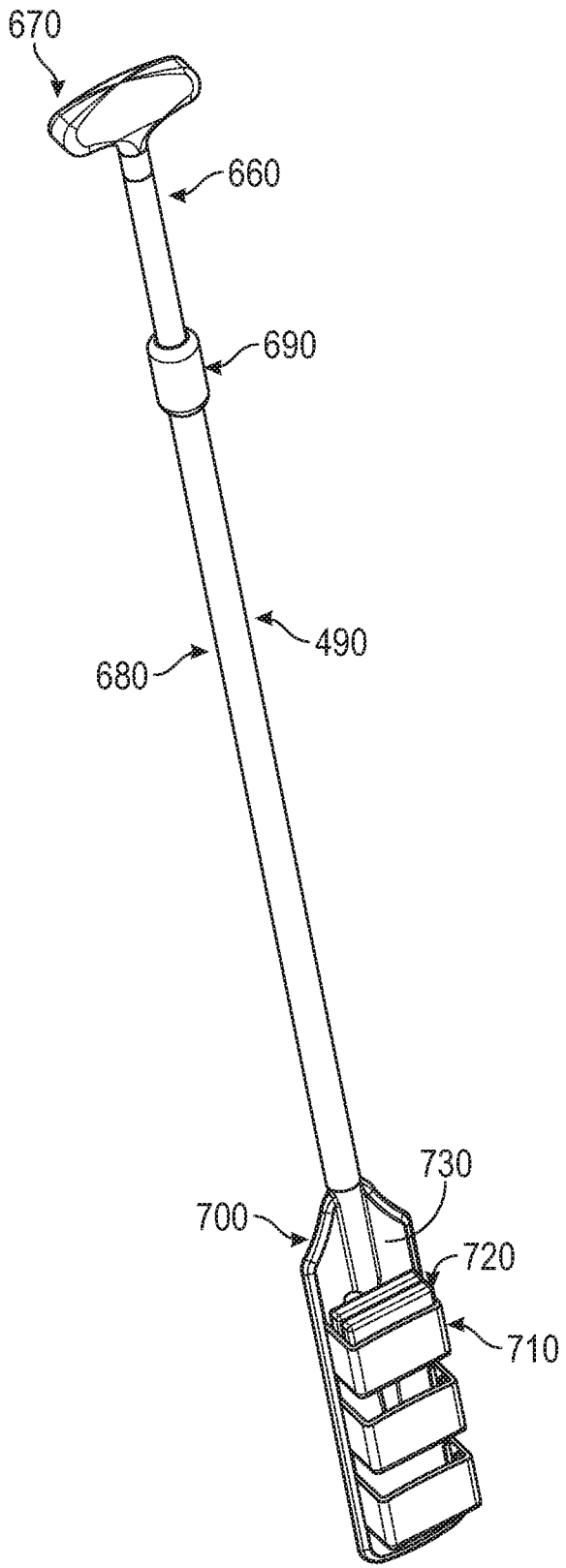
FIG. 19 is a perspective view of an embodiment of a paddle of the exercise device of FIG. 9.

With reference to FIGS. 10 and 19, the paddle 490 is similar to a stand-up paddleboard (SUP) paddle having an upper tube 660 with a grip 670 slidably received in a lower tube 680. The length of the paddle 490 is adjustable via a collar 690. The lower portion 480 of paddle 490 includes a blade 700 with one or more weight-receiving holders 710 that hold removable weight(s) 720 along a first side 730 of the blade 700 and a plurality of blade couplers 740 along an opposite second side 750 of the blade 700. The connector 470 of the retractable cord/cable 370 couples with the blade 700 of the paddle 490 at one of the couplers 740. The resistance and/or difficulty of a paddling motion with the paddle 490 is increased and decreased by one or both of adding more weight(s) 720 to the weight-receiving holders 710 and coupling the retractable cord/cable 370 lower on the blade 700 with one of the lower couplers 740.

In use, the user rows with the connected paddle 490 of the exercise device 300 as one rows with a paddle of a SUP, with rowing resistance provided with each stroke by the resistance mechanism 360 (in conjunction with the resistance provided by the weight(s) 720 and coupling location of the retractable cord/cable 370 to the blade 700), taking one or more strokes with the paddle 490 on one side of the exercise device 300, taking one or more strokes with the paddle 490 on an opposite side of the exercise device 300, and repeating this process, while trying to maintain one's balance on the movable balancing support 350 of the balancer 345, similar to trying to balance on a SUP while rowing.

Figure 20:
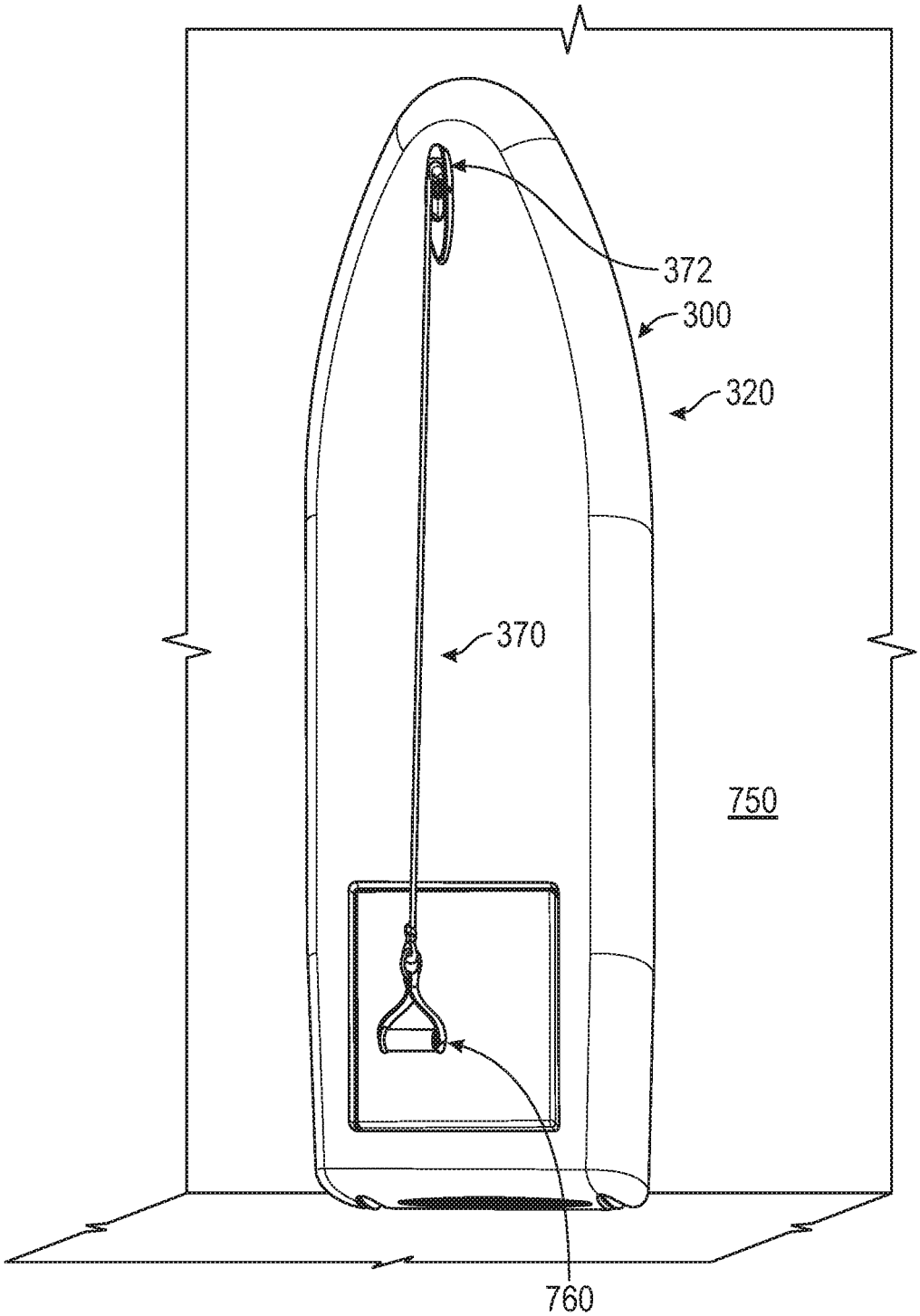
FIG. 20 is a perspective view of the exercise device of FIG. 9 shown mounted vertically to a wall.

With reference to FIG. 20, the exercise device 300 may be coupled to a wall or door 750, and one or more accessories (e.g., handle(s) 760) may be coupled to the connector 470 at a terminal end of the retractable cord/cable 370.

Figure 9:
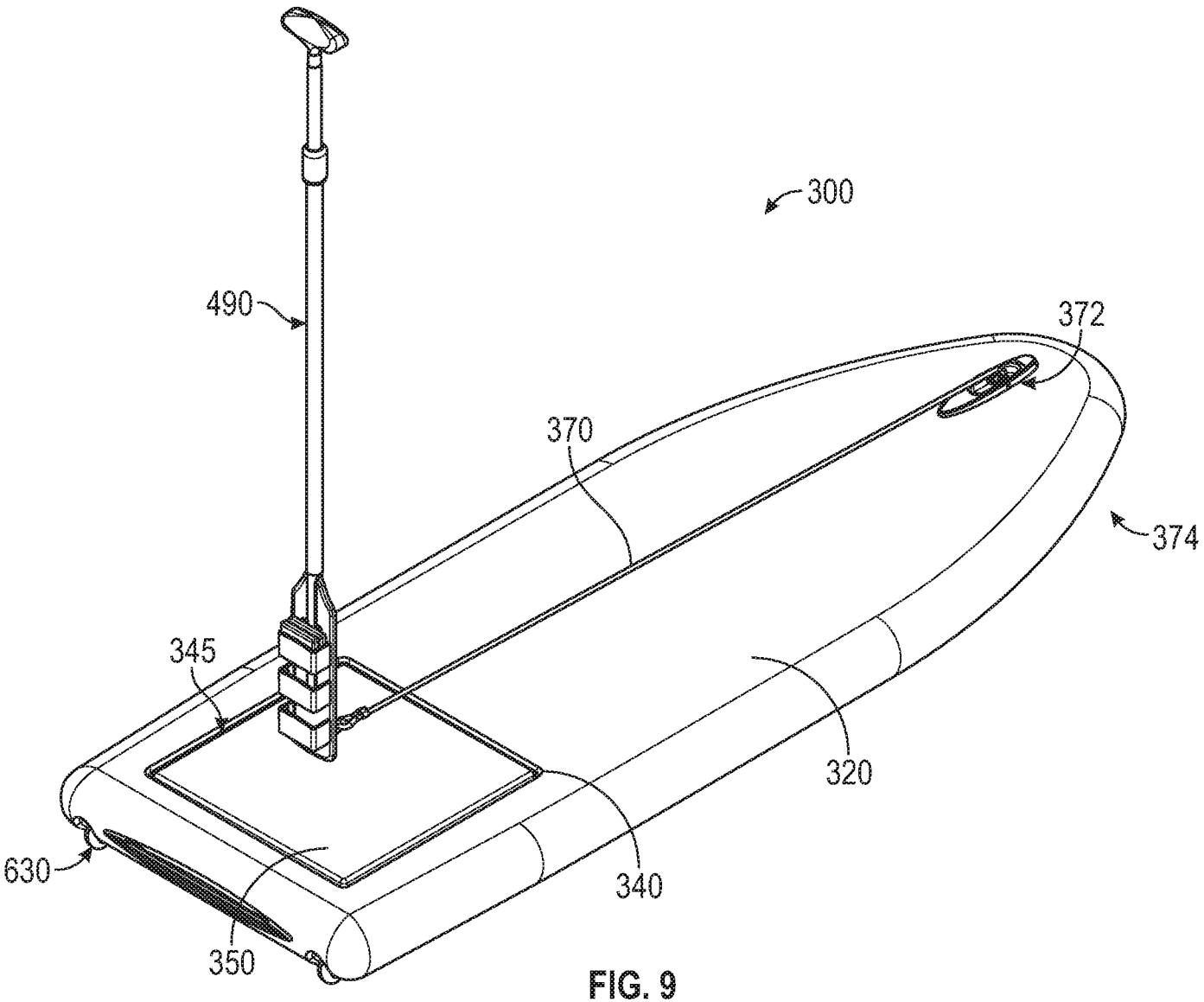
FIG. 9 is a perspective view of another embodiment of an exercise device.

Examples of exercises that may be performed with the exercise device 300 oriented in a horizontal position as shown in FIG. 9 or a vertical position as shown in FIG. 20 include, but are not limited to following: standing exercises (e.g., paddling, rowing, chest presses, overhead presses, alternating arms forward and backward PNF patterns, Rotator Cuff exercises); kneeling exercises (e.g., kettle bells, squats, squat and press, single leg squats, front lunges, side lunges, diagonal lunges, biceps curls, triceps presses, heel raises, toe raises, reverse flies, shoulder externally and internally rotation, PNF patterns); sideways exercises (e.g., PNF patterns, shoulder abduction, trunk rotation); sitting exercises (e.g., paddling, rowing, chest presses, PNF patterns); lying face up/supine exercises (e.g., shoulder extension, abduction pull downs, PNF patterns).

Advantages of the exercise device 100, 300 include, but are not limited to, versatility (as shown and described herein), provides for a full body workout, uses almost every muscle in your body, improves cardiovascular health, aids in weight loss, increases strength, improves balance and focus, reduces stress, provides a low impact activity, stand up paddling burns more calories than almost any other form of exercise, tremendous core stability activity, increases endurance, provides functional training/proprioceptive neuromuscular facilitation ("PNF") incorporates mass movement patterns that are diagonal and spiral in nature and often cross the midline of the body (everyday tasks and skills, from picking up a bottle of water to throwing and kicking naturally utilize diagonal and spiral movements), and increases flexibility and coordination.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. An exercise device that simultaneously incorporates both balance and resistance training, comprising:

a base including a front portion;

a balancer disposed in the base proximal to the front portion of the base and configured to both support a user thereon and move with weight shifting by the user thereon;

one or more lines retractably disposed in the front portion of the base;

a resistance mechanism disposed in the base and operably associated with the one or more lines, wherein the base includes a longitudinal direction and a lateral direction, and the balancer includes a movable balancing support that pivots side-to-side in the lateral direction when the user attempts to balance the user's weight on the balancer, the balancer includes a plurality of springs that bias the movable balancing support in an opposite direction from a direction of movement of the movable balancing support when the movable balancing support pivots side-to-side in the lateral direction, the springs being replaceable by springs having different spring constants, and both balance and resistance training are provided by the balancer and the resistance mechanism when a user attempts to balance the user's weight on the balancer while pulling on the one or more lines.

2. The exercise device of claim 1, wherein the resistance mechanism includes one or more pulleys, one or more cables, and one or more elastic cords.

3. The exercise device of claim 2, wherein the one or more elastic cords are replaceable by one or more elastic cords having different elasticities.

4. The exercise device of claim 1, further including a cover on top of the base, and the cover has a configuration of a SUP.

5. A method of using the exercise device of claim 1, the exercise device including a paddle having one or more tubes having a grip at one end and an opposite end with a blade coupled to the one or more lines, the blade including one or more couplers coupled to the one or more lines, the one or more couplers including a plurality of couplers spaced at varying distances, comprising:

providing balance training with the exercise device by supporting a user on the balancer and the balancer moving with weight shifting by the user thereon;

providing resistance training with the exercise device via the one or more lines by the resistance mechanism by the user pulling on the one or more lines;

varying paddling resistance by varying which coupler the one or more lines is coupled to.

6. The method of claim 5, wherein the base includes a longitudinal direction and a lateral direction, and the balancer includes a movable balancing support that pivots side-to-side in the lateral direction when the user attempts to balance the user's weight on the balancer, and providing balance training includes the movable balancing support pivoting side-to-side in the lateral direction when the user attempts to balance the user's weight on the balancer.

7. The method of claim 6, wherein the balancer includes a plurality of springs that bias the movable balancing support in an opposite direction from a direction of movement of the movable balancing support when the movable balancing support pivots side-to-side in the lateral direction, and providing balance training includes the plurality of springs biasing the movable balancing support in an opposite direction from a direction of movement of the movable balancing support when the movable balancing support pivots side-to-side in the lateral direction.

8. The method of claim 7, wherein the springs are replaceable by springs having different spring constants, and the method includes the springs being replaced by the springs having different spring constants.

9. The method of claim 5, wherein the resistance mechanism includes one or more replaceable elastic cords, and the method includes the one or more replaceable elastic cords being replaced by one or more elastic cords having different elasticities to vary resistance training.

10. The method of claim 5, further including a paddle having one or more tubes having a grip at one end and an opposite end with a blade coupled to the one or more lines, the blade including one or more weight-receiving holders and one or more weights received in the one or more weight-receiving holders, and the method includes varying paddling resistance by replacing the one or more weights with one or more different weights in the one or more weight-receiving holders.

11. An exercise device that simultaneously incorporates both balance and resistance training, comprising:

a base including a front portion;

a balancer disposed in the base proximal to the front portion of the base and configured to both support a user thereon and move with weight shifting by the user thereon;

one or more lines retractably disposed in the front portion of the base;

a resistance mechanism disposed in the base and operably associated with the one or more lines;

a paddle having one or more tubes having a grip at one end and an opposite end coupled to the one or more lines, the opposite end including a blade that is coupled to the one or more lines;

wherein the blade includes one or more weight-receiving holders and one or more weights received in the one or more weight-receiving holders, paddling resistance is varied depending on the amount of the one or more weights received in the one or more weight-receiving holders, and both balance and resistance training are provided by the balancer and the resistance mechanism when a user attempts to balance the user's weight on the balancer while pulling on the one or more lines.

12. The exercise device of claim 11, wherein the blade includes one or more couplers coupled to the one or more lines.

13. The exercise device of claim 12, wherein the one or more couplers include a plurality of couplers spaced at varying distances, wherein paddling resistance is varied depending on which coupler the one or more lines is coupled to.

14. The exercise device of claim 11, wherein the paddle has a configuration of a SUP paddle.

15. An exercise device that simultaneously incorporates both balance and resistance training, comprising:

a base including a front portion;

a balancer disposed in the base proximal to the front portion of the base and configured to both support a user thereon and move with weight shifting by the user thereon;

one or more lines retractably disposed in the front portion of the base;

a resistance mechanism disposed in the base and operably associated with the one or more lines, the resistance mechanism including one or more elastic cords that are replaceable by one or more elastic cords having different elasticities, wherein both balance and resistance training are provided by the balancer and the resistance mechanism when a user attempts to balance the user's weight on the balancer while pulling on the one or more lines.

16. An exercise device that simultaneously incorporates both balance and resistance training, comprising:

a base including a front portion;

a balancer disposed in the base proximal to the front portion of the base and configured to both support a user thereon and move with weight shifting by the user thereon;

one or more lines retractably disposed in the front portion of the base;

a resistance mechanism disposed in the base and operably associated with the one or more lines;

a paddle having one or more tubes having a grip at one end and an opposite end including a blade with a plurality of couplers spaced at varying distances configured to be coupled to the one or more lines whereby paddling resistance is varied depending on which coupler the one or more lines is coupled to, wherein both balance and resistance training are provided by the balancer and the resistance mechanism when a user attempts to balance the user's weight on the balancer while pulling on the one or more lines.

17. A method of using an exercise device, the exercise device comprising a base including a front portion; a balancer disposed in the base proximal to the front portion of the base and configured to both support a user thereon and move with weight shifting by the user thereon; one or more lines retractably disposed in the front portion of the base; a resistance mechanism disposed in the base and operably associated with the one or more lines, wherein both balance and resistance training are provided by the balancer and the resistance mechanism when a user attempts to balance the user's weight on the balancer while pulling on the one or more lines, comprising:

providing balance training with the exercise device by supporting a user on the balancer and the balancer moving with weight shifting by the user thereon;

providing resistance training with the exercise device via the one or more lines by the resistance mechanism by the user pulling on the one or more lines, wherein the base includes a longitudinal direction and a lateral direction, and the balancer includes a movable balancing support that pivots side-to-side in the lateral direction when the user attempts to balance the user's weight on the balancer and a plurality of springs that bias the movable balancing support in an opposite direction from a direction of movement of the movable balancing support when the movable balancing support pivots side-to-side in the lateral direction, and providing balance training includes the plurality of springs biasing the movable balancing support in an opposite direction from a direction of movement of the movable balancing support when the movable balancing support pivots side-to-side in the lateral direction, the springs being replaceable by springs having different spring constants, and the method including the springs being replaced by springs having different spring constants.

18. A method of using an exercise device, the exercise device comprising a base including a front portion; a balancer disposed in the base proximal to the front portion of the base and configured to both support a user thereon and move with weight shifting by the user thereon; one or more lines retractably disposed in the front portion of the base; a resistance mechanism disposed in the base and operably associated with the one or more lines, wherein both balance and resistance training are provided by the balancer and the resistance mechanism when a user attempts to balance the user's weight on the balancer while pulling on the one or more lines, comprising:

providing balance training with the exercise device by supporting a user on the balancer and the balancer moving with weight shifting by the user thereon;

providing resistance training with the exercise device via the one or more lines by the resistance mechanism by the user pulling on the one or more lines, wherein the resistance mechanism includes one or more replaceable elastic cords, and the method includes the one or more replaceable elastic cords being replaced by one or more elastic cords having different elasticities to vary resistance training.

19. A method of using an exercise device, the exercise device comprising a base including a front portion; a balancer disposed in the base proximal to the front portion of the base and configured to both support a user thereon and move with weight shifting by the user thereon; one or more lines retractably disposed in the front portion of the base; a resistance mechanism disposed in the base and operably associated with the one or more lines, wherein both balance and resistance training are provided by the balancer and the resistance mechanism when a user attempts to balance the user's weight on the balancer while pulling on the one or more lines, comprising:

providing balance training with the exercise device by supporting a user on the balancer and the balancer moving with weight shifting by the user thereon;

providing resistance training with the exercise device via the one or more lines by the resistance mechanism by the user pulling on the one or more lines, wherein the exercise device includes a paddle having one or more tubes having a grip at one end and an opposite end with a blade coupled to the one or more lines, the blade including one or more weight-receiving holders and one or more weights received in the one or more weight-receiving holders, and the method includes varying paddling resistance by replacing the one or more weights with one or more different weights in the one or more weight-receiving holders.

20. A method of using an exercise device, the exercise device comprising a base including a front portion; a balancer disposed in the base proximal to the front portion of the base and configured to both support a user thereon and move with weight shifting by the user thereon; one or more lines retractably disposed in the front portion of the base; a resistance mechanism disposed in the base and operably associated with the one or more lines, wherein both balance and resistance training are provided by the balancer and the resistance mechanism when a user attempts to balance the user's weight on the balancer while pulling on the one or more lines, comprising:

providing balance training with the exercise device by supporting a user on the balancer and the balancer moving with weight shifting by the user thereon;

providing resistance training with the exercise device via the one or more lines by the resistance mechanism by the user pulling on the one or more lines, wherein the exercise device includes a paddle having one or more tubes having a grip at one end and an opposite end with a blade coupled to the one or more lines, the blade including one or more couplers coupled to the one or more lines, the one or more couplers including a plurality of couplers spaced at varying distances, and the method includes varying paddling resistance by varying which coupler the one or more lines is coupled to.

* * * * *